United States Patent [19]

Clark

[11] 4,443,954

[45] Apr. 24, 1984

[54] MASONRY GUIDE

[76] Inventor: John S. Clark, P.O. Box 71, Hines, Oreg. 97738

[21] Appl. No.: 421,235

[22] Filed: Sep. 22, 1982

[51] Int. Cl.[3] ..... G01C 15/10

[52] U.S. Cl. ..... 33/404; 33/406

[58] Field of Search ..... 33/404, 405, 406, 407–409, 33/413

[56] References Cited

U.S. PATENT DOCUMENTS

| | | | |
|---|---|---|---|
| 1,336,004 | 4/1920 | Victoria | 33/404 |
| 2,420,797 | 5/1947 | Raymond | 33/404 |
| 2,949,673 | 8/1960 | Belcher | 33/406 |
| 3,348,312 | 10/1967 | Jones | 33/406 |

*Primary Examiner*—Willis Little

*Attorney, Agent, or Firm*—Paul F. Horton

[57] ABSTRACT

A masonry guide including an upright standard; a fork affixed to the standard adjacent its lowermost end for engaging the external corner of a building structure; a pair of arms pivotally engaging the standard at right angles to one another, the arms each carrying a common pin and an end pin adapted for placement upon the top surface of the walls under construction; and adjustment rods pivotally and angularly connected between the standard and each arm for vertically plumbing the standard and for providing arm support. Guide line blocks are attachable to the standard for holding horizontally extending guidelines in place. The masonry guide also preferably includes a pair of spirit levels adjacent the top of the standard for vertical positioning of the standard and may also include a measurement rule for setting of guidelines at proper height. An accessory pin, rearwardly extending from the standard, cooperates with the end pins of the arms to permit the device to be used on an internal corner.

10 Claims, 4 Drawing Figures

MASONRY GUIDE

BACKGROUND OF THE INVENTION

1. Field of the Invention

This invention relates to masonry guides for use in brick laying.

2. Description of the Prior Art

Masonry guides have long been used for proper alignment of successive courses of brick or block. Of particular importance in the art of brick laying has been the preparation of "leaders", the corner construction which is built prior to the filling in of the walls therebetween. It has been essential that the leaders be both plumb and level and for this reason special care has been given in such construction. Because of the time involved in the construction of leaders, cost effectiveness has been adversely affected. It is therefore highly desirable that equipment be designed for greater speed of construction. Efforts in this regard include the devices of Platt, U.S. Pat. No. 1,004,194, which is affixed to the brick structure; of Wilkinson, U.S. Pat. No. 2,685,471, having abuttment plate projections entering spaces between previously layed bricks for affixing the apparatus to a brick structure; and of Cantera, U.S. Pat. No. 4,057,903 which utilizes an adjustable retaining line for holding the apparatus in place. Problems associated with prior art devices include mechanical attachments to the wall itself with loss of time in placement and removal; requirement of retaining structure between opposing devices; inoperability at the foundation level because of lack of fastening means; disturbance of leveling and plumbing functions because of guideline pull; inoperability for inside corner use; and lack of adjustment capability both as to 4-way adjustment and as to the effect of the adjustment in one plane relative to another.

SUMMARY OF THE INVENTION

In view of the foregoing discussion, it is a primary object of the present invention to provide a masonry guide which is self-contained and which requires no assembling at the job site.

It is also a primary object of the present invention to provide a guide which requires no attachment to the building structure when used on external corners.

More particularly, it is an important object of the present invention to provide a masonry guide which rests upon the top surface of the foundation or wall upon which successive layers of bricks are to be laid.

Another object of the present invention is to provide a masonry guide which is 4-way adjustable and which permits adjustment in one plane without affecting adjustment in a second plane.

A still further object of the present invention is to provide a masonry guide which permits pre-attachment of guidelines and which utilizes guideline tautness as an additional means of support.

Additional objects and advantages will become apparent and a more thorough and comprehensive understanding may be had from the following description taken in conjunction with the accompanying drawings forming a part of this specification.

DETAILED DESCRIPTION OF THE INVENTION

Figure 4:
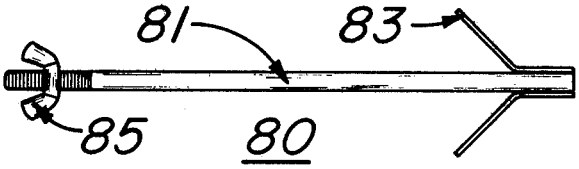
FIG. 4 is a plan view of an accessory used with the masonry guide for internal corner use.

Referring now to the drawings, an embodiment to be preferred of a masonry guide 10, made according to the present invention, is disclosed. Masonry guide 10 includes a vertically upright standard 20, a fork 30, arms 40 carrying a common pin 45 and end pins 47, and adjustment means designated generally by the numeral 50. Guideline attachment means 60 are operable to connect guidelines 65 to the standard.

Standard 20 is preferably constructed of right angle stock approximately three feet in length. The standard serves as a base for connection of all other parts. At its upper end the standard carries a pair of spirit levels 15, each mounted on one of the flanges making up the standard and set at right angles one to the other.

Adjacent the lowermost end, standard 20 carries a fork, in the form of a right angle bracket, which is operable to engage the intersecting exterior surfaces of a corner building structure. Depth of the brackets defining the fork is one-eighth inch so that the interior corner engaging surfaces of the fork are inset one-eighth inch relative to the exterior surfaces of the flanges defining the angle iron of which the standard is constructed. When plumbed, the external surfaces of the standard are therefore set out one-eighth inch relative to the walls comprising the corner of the building structure, for purposes which shall hereinafter be explained.

Figure 3:
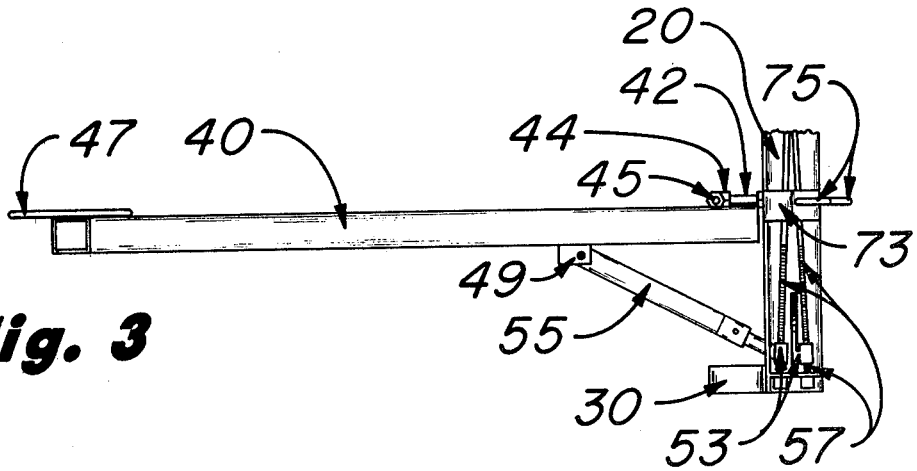
FIG. 3 is a partial side view of a masonry guide made according to the present invention.

Approximately six inches above fork 30 a pair of arms 40 pivotally engage standard 20 at right angles one to the other. Each of the horizontally extending arms are approximately two feet in length. Each arm carries on its upper surface a pin 47 adjacent its terminal free end. Each pin preferably projects outwardly over each of the sides of each arm, parallel to one another and at a 45° angle to the arm, as shown in the figures. Pins 47 cooperate with a common pin 45, affixed to and outwardly extending from the front of standard 20, for resting the apparatus on a corner foundation or wall. Pin 45 is preferably C-shaped in form and serves as a pivot pin for arms 40 in their engagement with standard 20, as shown in FIG. 3. Sleeves 44, welded to the top surfaces of arms 40 and to standard 20 by means of a connector rod 42, receive common pin 45 to allow pivoting of the arms relative to the standard.

Figure 1:
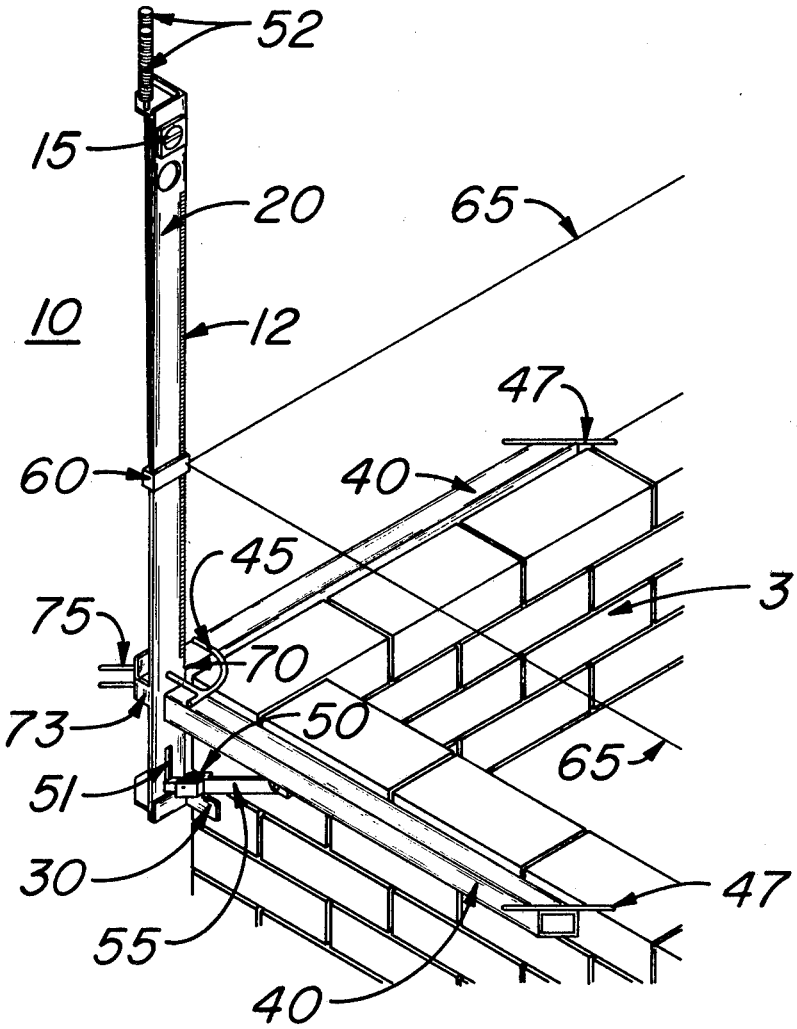
FIG. 1 is a perspective view of a masonry guide constructed in accordance with the present invention shown in use on an external corner.
Figure 2:
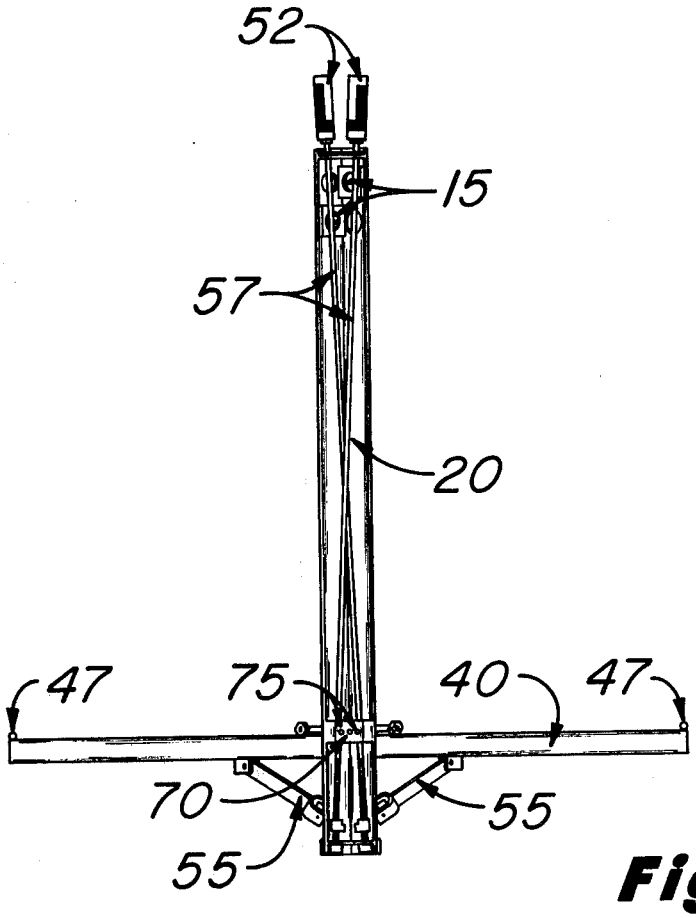
FIG. 2 is a rear view of the apparatus of FIG. 1.

Pivotally attached to each arm, as by pin and bracket assembly 49, is an adjustment rod 55. Each adjustment rod is, in the preferred embodiment, pivotally connected to a threaded nut 53 which threadably engages a rotatable extension rod 57. As extension rod 57 is rotated, nut 53 moves upwardly or downwardly on the rod causing the standard to pivot in a single plane relative to the arm adjusted. Slots 51, shown in FIG. 1, permit vertical movement of rods 55 within the standard. Handles 52, located adjacent the top of the standard permit convenient rotation of rods 57 for adjustment. In other embodiments, not shown, adjustment means 50 may include a single pivotal and threaded rod-nut assembly extending between each arm and the standard. While completely satisfactory and within the contemplation of the invention, such an adjustment is not as convenient as the assembly herein described. It is to be noted that adjustment rod 55 is in a triangular relationship with arm and standard and serves as a support as well as means of adjustment. Guideline attachment means 60 for attachment of guidelines 65 to standard 20 are conventional in the art and any desired means of securing attachment will suffice. Standard guideline blocks are readily available.

For use on internal corners, masonry guide 10 includes one or more alternate common pins 75 rearwardly extending from spacer brackets 73 affixed to standard 20 at the same level as common pin 45 for placement on the top surface of an inner corner structure. Alternate pins 75 cooperate with end pins 47 on each arm for resting the apparatus on a corner building structure. Additionally, where the masonry guide is to be used on internal corners, standard 20 is provided with a pair of aligned apertures 70 through the front of the standard and through brackets 73, through which extends rod 81 of accessory 80, as shown in FIG. 4. Unlike the use of external corners, guidelines 65 do not operate to stabilize the masonry guide, but rather tend to pull the guide inwardly off the supporting building structure. For this reason, the rod 81 is placed through the aligned aperture and the interior surfaces of right angle bracket 83 is caused to engage the exterior surface of the corner of the building structure and wing nut 85 is tightened to secure the apparatus in place. The accessory rod can be pulled out the backside of the brick work after completing the new brick work. A tie wire may be substituted for the rod, where desired.

For use on setting external corners, instead of the time-consuming construction of "leaders" as is customary, the operator simply places a masonry guide 10 at respective corners of the building structure to be constructed. Since each guide 10 is operated in the same manner, the description of one such setting shall suffice. Guide 10 is placed either upon the foundation or on an existing wall 3, as the case may be, with pins 47 of arms 40 and common pin 45 engaging the exterior top surface of the structure and the interior surfaces of fork 30 engaging the exterior vertical surfaces of the corner of the structure. Guidelines 65, stretched taut, are then attached to opposing standards 20 by guideline attachment means 60, preferably in the form of guideline blocks. As guidelines 65 are tightened, pins 47 tend to slide over the surface of structure upon which they rest and fork 30, at the extreme bottom of the standard, is forced snug to the corner, thus holding guide 10 rigidly in place. Handles 52 extension rods 57 are then rotated to plumb the standard. It is to be noted that each handle may be rotated in either direction which effectively moves the standard back and forth in a single plane, two directions, without affecting positioning in another plane. Adjustment means 50, therefore allows positioning in four directions—a 4-way adjustment. Spririt levels 15 permit visual determination as to the plumb position. A measuring rule 12 placed upon standard 20 may be used to determine proper height of guidelines 65.

Fork 30 is so designed as to allow for a difference between the corner structure and the vertically upright standard of approximately one-eighth inch. In cooperation with line block 60 which permit the guideline to be spaced outwardly from the two flange faces of standard 20, the first brick off the corner may be placed to the guidelines for proper positioning. Additionally, it is to be emphasized that the one-eighth inch difference between fork and standard frees the standard from coming into contact with existing corner brick to free the standard for plumbing.

Having thus described in detail a preferred embodiment of the present invention, it is to be appreciated and will be apparent to those skilled in the art that many physical changes could be made in the apparatus without altering the inventive concepts and principles embodied therein. The present embodiments are therefore to be considered in all respects as illustrative and not restrictive, the scope of the invention being indicated by the appended claims rather than by the foregoing description, and all changes which come within the meaning and range of equivalency of the claims are therefore to be embraced therein.

I claim:

1. A masonry guide comprising:

a vertically upright standard;

a fork secured to said standard adjacent its lower end, said fork adapted to engage the corner of a building structure;

a pair of horizontally extending arms pivotally engaging said standard at right angles one to another, each of said arms provided with a pin adjacent its terminal end, and a common pin adjacent their pivotal ends, said pins adapted for positioning upon the top surface of a corner building structure;

adjustment means connected between and pivotally engaging said standard and each of said arms for plumbing said standard; and guideline attachment means connected to said standard above said arms for holding one or more guidelines in place.

2. The apparatus as described in claim 1 wherein said adjustment means includes two adjustment rods, each rod pivotally connected to one of said arms and downwardly inclined to a pivotal connection with said standard for supporting said arms relative to said standard.

3. The apparatus as described in claim 1 wherein each of the two pins mounted adjacent the terminal free ends of said arms are in parallel relationship with one another.

4. The apparatus as described in claim 1 wherein each of the two end pins project outwardly in opposing directions from each of the two arms for contacting the upper surface of a partially constructed brick wall when the masonry guide is used on either internal or external corners.

5. The apparatus as described in claim 1 wherein said fork is inset a selected distance relative to said standard for guideline allowance.

6. The apparatus as described in claim 1 wherein said standard is provided with one or more alternate common pins oppositely disposed from said common pin and wherein said arms each include a pin extending outwardly in substantially the same direction as said alternate common pins whereby the apparatus may be placed at the inner corner of a building structure for positioning of interior guidelines.

7. The apparatus as described in claim 1, further comprising plumbing means.

8. The apparatus as described in claim 7 wherein said plumbing means includes at least two spirit levels disposed at right angles one to the other.

9. The apparatus as described in claim 1 further comprising at least one measuring rule positioned longitudinally upon said standard.

10. The apparatus as described in claim 1 wherein said adjustment means includes an adjustment rod pivotally and angularly connected between each of said arms and said standard.

* * * * *